United States Patent [19]

Sindermann

[11] 4,410,090

[45] Oct. 18, 1983

[54] DEVICE FOR TESTING AND SORTING BOTTLES

[75] Inventor: Siegmar Sindermann, Kamen-Heeren, Fed. Rep. of Germany

[73] Assignee: Holstein und Kappert GmbH, Dortmund, Fed. Rep. of Germany

[21] Appl. No.: 241,377

[22] Filed: Feb. 26, 1981

[30] Foreign Application Priority Data

Feb. 28, 1980 [DE] Fed. Rep. of Germany ..... 3007540

[51] Int. Cl.[3] ..... B07C 5/10

[52] U.S. Cl. ..... 209/525; 209/617

[58] Field of Search ..... 209/525, 526, 527, 528, 209/529, 530, 531, 532, 533, 617, 618, 524, 523, 586; 250/223 B

[56] References Cited

U.S. PATENT DOCUMENTS

| | | | |
|---|---|---|---|
| 1,949,767 | 3/1934 | Thompson | 209/617 |
| 2,643,766 | 6/1953 | Nordquist | 209/617 |
| 2,738,066 | 3/1956 | Gueffroy | 209/617 |
| 3,259,240 | 7/1966 | Schneider | 209/523 |
| 3,351,198 | 11/1967 | Wyman | 209/528 |
| 3,434,594 | 3/1969 | Husome | 209/525 |
| 3,975,260 | 8/1976 | Peyton et al. | 209/617 X |

*Primary Examiner*—Allen N. Knowles
*Attorney, Agent, or Firm*—Michael J. Striker

[57] ABSTRACT

A device for detecting and sorting out bottles of improper size is suggested in a bottle treatment machine of the type including a filling and closing sections switched in series. The bottles are fed to a cleaning test device and on the way thereto are tested by a recognition device which scans the bottles of improper size and actuates a closing control arrangement adapted to activate grippers on the device of transferring bottles to the cleaning test device such that those grippers do not grip defective bottles which are then withdrawn from the bottle transferring device.

4 Claims, 2 Drawing Figures

DEVICE FOR TESTING AND SORTING BOTTLES

BACKGROUND OF THE INVENTION

The invention relates to a device for testing and sorting out of defective bottles or faulty bottles in a bottle treatment device, for example, consisting of a filling and closing machine with a labelling device switched in series, whereby the bottles to be filled are subjected to a cleaning test before moving into the filling machine and for this purpose are fed to an indexing section and a transfer path associated therewith and to a subsequent sorting section.

Such devices are particularly used when the bottles which are fed from a bottle washing machine to a filling machine must be subjected to a test. This testing is carried out for safety reasons, in particular for detecting lye solution remained in the bottles. For example, the bottles are picked up by an index screw and fed to the required index distance of the test device. After the corresponding index distance has been reached they are fed into a transfer star which is provided with gripper units which grip the bottles, in particular at the opening area and feed the bottles into the range of an optic recognition device. As soon as dirty bottles, or the like, are required, the optic recognition device is effective on a sorting deflector which sorts out the recognized bottles and returns the bottles to the bottle cleaning device.

This very compact device may be disposed directly at the input of a filler machine, so that the operator may also supervise the actual testing device.

However, with such a testing device it is not possible to recognize defective bottles, that is, bottles of a deviating size. These bottles also are fed into the area of the devie and create considerable inteferences due to the different measurements, in particular deviations in height. It is known, to sort out such defective bottles before the input area, that is, the path between the cleaning machine and the filling machine. However, for this purpose an additional operator is required.

SUMMARY OF THE INVENTION

It is an object of the invention to recognize defective bottles notwithstanding their degree of contamination in a known optical testing device by using the required bottle treatment units and to move the defective bottles downwardly or laterally before the actual cleaning test, whereby all units may be continuously and simultaneously used for the cleaning test of the given normal bottles.

This object of the invention is obtained in accordance with the invention in a device of the aforementioned type in that at the height of the first index section (index screw) a recognition device is provided for scanning the bottle shape which device is effective on the closing control of the gripper units which form the transfer star and whose gripper device is brought into an opening position at least over a partial area of the transfer star circumference path, and that a sorting path is provided between this predeterminable circumference path and subsequently thereto a known cleaning test device with subsequent sorting deflection.

It is now possible with the inventive design to test and sort out defective bottles by using units of a cleaning test device, whereby additional units for gripping and sorting out or separating of defective bottles in a bottle treatment device can be omitted.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
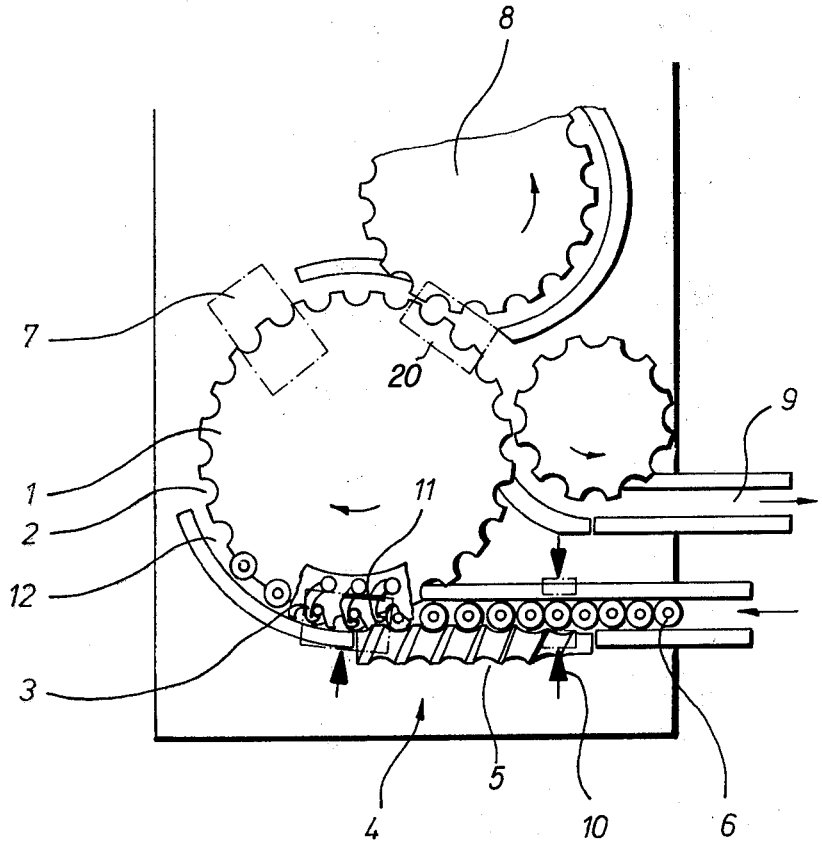
FIG. 1 is a schematic side view of the device according to the invention.

In accordance with the exemplified embodiment shown in FIG. 1, a device consists of the transfer star 1, whereby each pocket 2 of this star is provided with gripper units 3, not shown in detail. One index path, for example, is shaped by an index screw conveyor 5 at the inlet area 4 with the transfer star 1, whereby the randomly introduced bottles 6 are fed consecutively and continuously to the transfer star 1 or the subsequent bottle treatment device to be positioned at the required separating distance.

An optical test device 7 is provided in the center third of the transfer star 1. When the test device recognizes a dirty bottle it responds to a deflector 20 (known in the art) provided between the transfer star 1 and a discharge star 8, whereby the dirty bottles are deflected and fed to a discharge belt 9. As can be seen from FIG. 1, a recognition device 10 is provided in the area of the index screw conveyor 5. With this recognition system defective bottles have a size which deviates from the normal size will be recognized . A pulse generated in the recognition system is transmitted to a closing control 11 and to the given gripper units 3. As soon as a pulse is generated in the recognition device 10 by a defective bottle entering the conveyor, the closing control 11 is actuated and the incoming defective bottle is not gripped by the gripper unit 3 of a corresponding pocket 2. Thus the bottle is fed into the area of an opening 12 and is discharged downwardly or laterally of the path of the normal bottles. This opening 12 is disposed immediately behind the closing control 11 and ends in front of the optical test device 7.

Figure 2:
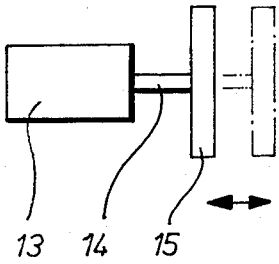
FIG. 2 is a somewhat schematic view of an actuating device

FIG. 2 shows the actuating device of the closing control 11 for controlling the gripper units 3. For example, this unit consists of a stroke magnet 13 the control rod 14 of which is provided with a take-off track 15 which engages against opening rollers provided in the gripper units, thus preventing closing of the corresponding gripper unit 3.

It will be understood that each of the elements described above, or two or more together, may also find a useful application in other types of testing devices differing from the types described above.

While the invention has been illustrated and described as embodied in a testing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a bottle treatment device wherein bottles to be filled are fed to cleaning test means, tested and thereafter unsuitable bottles are sorted out before the proper bottles enter a filling section of the device, an improvement comprising transfer means for transferring bottles to said cleaning test means, including a transfer star and a discharge star positioned to define a transfer circumferential path for the bottles; means for introducing bottles into said transfer means; said transfer star including a plurality of gripping units for holding individual bottles thereon; closing control means positioned on said transfer star in the vicinity of said introducing means and operative for bringing the gripping units positioned over a part of said circumferential path into an opening position to prevent them from gripping respective bottles; recognition means located on said introducing means and operative for scanning a bottle of a defective size, said recognition means actuating said closing control means for preventing the respective gripping units from gripping a bottle of a defective size; and means for discharging defective bottles from said circumferential path, said discharging means being disposed between said closing control means and said cleaning test means.

2. The device as defined in claim 1, wherein said introducing means include a screw conveyor operative to place randomly located bottles at a predetermined spaced-apart position from each other.

3. The device as defined in claim 1, wherein said closing control means includes a magnet adjusting device having a control rod provided with a take-off track adapted to actuate the respective gripping units to bring them into the opening position.

4. The device as defined in claim 3, wherein said discharging means is defined by an opening from which defective bottles are discharged downwardly and laterally of said path.

* * * * *